US007198332B2

(12) United States Patent
Kargl et al.

(10) Patent No.: US 7,198,332 B2
(45) Date of Patent: Apr. 3, 2007

(54) DEVICE FOR PRODUCING A GAS-LIQUID MIXTURE IN THE VICINITY OF CUTTING TOOLS

(75) Inventors: Hubert Kargl, Gaal (AT); Ralf Grief, Zeltweg (AT)

(73) Assignee: Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 10/528,672

(22) PCT Filed: Sep. 3, 2003

(86) PCT No.: PCT/AT03/00253

§ 371 (c)(1),
(2), (4) Date: Mar. 22, 2005

(87) PCT Pub. No.: WO2004/029412

PCT Pub. Date: Apr. 8, 2004

(65) Prior Publication Data

US 2006/0061205 A1 Mar. 23, 2006

(30) Foreign Application Priority Data

Sep. 24, 2002 (AT) ..... 1429/2002

(51) Int. Cl.
*E21C 35/23* (2006.01)

(52) U.S. Cl. ..... 299/81.1; 299/81.3

(58) Field of Classification Search ..... 299/81.1, 299/81.2, 81.3; 239/426, 433, 434, 543
See application file for complete search history.

(56) References Cited

U.S. PATENT DOCUMENTS

| | | | | |
|---|---|---|---|---|
| 4,186,971 | A * | 2/1980 | Gebetsroither et al. | 299/64 |
| 4,243,268 | A * | 1/1981 | Lobbe et al. | 299/32 |
| 4,676,557 | A * | 6/1987 | Shope et al. | 299/39.3 |
| 6,517,012 | B1 * | 2/2003 | Slowik et al. | 239/464 |

FOREIGN PATENT DOCUMENTS

| | | |
|---|---|---|
| DE | 36 09 754 A1 | 9/1987 |
| DE | 199 51 848 A1 | 5/2001 |
| DE | 100 47 341 C1 | 2/2002 |

* cited by examiner

*Primary Examiner*—John Kreck
(74) *Attorney, Agent, or Firm*—Chapman and Cutler LLP

(57) ABSTRACT

In a device for producing a gas-liquid mixture and, in particular, air-water mixture in the region of cutting tools, particularly chisels, arranged on at least one cutter head (10) rotationally mounted on a cutter arm (5) of a cutting machine (1), including at least one nozzle pair comprised of a nozzle (14) for ejecting a gas jet and a nozzle (13) for ejecting a liquid jet, wherein the axes (17, 18) of the nozzles (13, 14) of a nozzle pair are oriented in a manner that the jets impinge on each other at a distance from the outlet openings of the nozzles, the axes (17, 18) of the nozzles (13, 14) of a nozzle pair form an angle with each other of between 45 and 135°, preferably between 75 and 85°.

15 Claims, 3 Drawing Sheets

DEVICE FOR PRODUCING A GAS-LIQUID MIXTURE IN THE VICINITY OF CUTTING TOOLS

The invention relates to a device for producing a gas-liquid mixture and, in particular, air-water mixture in the region of cutting tools, particularly chisels, arranged on at least one cutter head or cutter drum rotationally mounted on a cutter arm of a cutting machine, including at least one nozzle pair comprised of a nozzle for ejecting a gas jet and a nozzle for ejecting a liquid jet, the axes of the nozzles of a nozzle pair being oriented in a manner that the jets impinge on each other at a distance from the outlet openings of said nozzles.

Devices of the initially defined kind, for instance, are to be taken from DE 19951848 A1. Moreover, a number of devices are known, in which cooling water or water-air mixtures are introduced into the cutting traces of cutters so as to enable sparks to be extinguished and the cutting trace behind the chisel to be cooled. Such nozzling realized by the aid of air and/or water is, for instance, known as single-chisel nozzling, in which the release of the nozzle is controlled as function of a displacement movement of a chisel caused by reaction forces. Alternatively, devices for forming a more or less uniform spray mist have been proposed, which direct the spray jets onto the cutting unit to produce a spray mist enveloping the cutting unit. A device of this type is, for instance, known from DE 3609754 A1.

Nozzling means for cutter head chisels in the first place serve the purpose of dust abatement and to reduce the risk of ignition of an escaping methane-gas-air mixture. Cooling of the chisel naturally also aims to reduce wear. In that case, nozzling is often realized by the aid of a gas-liquid mixture and, in particular, air-water mixture, whereby several methods have become known to produce such air-water mixtures. To this end, in the method known from DE 19532459, a spray mist jet is produced of air and water by atomization, which spray mist jet is used to act upon the chisels and/or cutting traces in order to prevent scarfing in the region of the cutting area. To produce an air-water mixture, DE 2816797 A1 proposes to provide in the air outlet channels radial bores communicating with a water-conducting volume so as to cause water and air to exit the nozzles in the atomized state. The axes of those nozzles are oriented towards that cutter head side on which the chisels come out from the rock. From DE 19851620 A1, a nozzling system has become known, in which the spraying nozzles are configured as mist projectors into whose projector bores, which are connected with the compressed-air-fed air chamber, a water injection nozzle fed with water under pressure each opens to produce a water jet extending in the longitudinal direction of the projector bore, the pressure of the water under pressure being higher than that of the compressed air.

In the nozzling device according to DE 19951848 A1, from which the present invention departs, at least one water nozzle generating a water jet is associated with an air nozzle in a manner that the air jet and the water jet contact each other at a distance from the nozzle outlet openings while forming an air-water mixture that acts upon the cutter head. In that case, the individual nozzles are arranged, and the axes of said nozzles are oriented, in a manner that the air and water jets meet each other at angles of about 10 to 15°.

The known nozzle systems, however, have in common that quite considerable amounts of water must be supplied to produce water-air mixtures, which involves the disadvantage of the floor being soaked and hence no longer safeguarding the secure and precise displaceability of a cutter or advance working machine. The invention, therefore, aims to provide a device for producing a gas-liquid mixture of the initially defined kind, which allows for efficient atomization in the region of the cutting units using even small amounts of liquid so as to prevent undue soaking. At the same time, as fine an atomization of the liquid as possible is to be ensured in order to reduce the risk of ignition in the region of the cutting unit. Finally, the device according to the invention is to provide sufficient cooling of the cutting tools and, in particular, chisels despite those small amounts of liquid. To solve this object, the device according to the invention, departing from the nozzling device mentioned in the beginning, essentially consists in that the axes of the nozzles of a nozzle pair form an angle with each other of between 45 and 135°, preferably between 75 and 85°. Due to the fact that, unlike with known devices, the liquid and gas nozzles are oriented in a manner that a liquid jet and a gas jet impinge on each other at an angle of between 45 and 135°, particularly effective atomization will be ensured while forming a mist having a droplet spectrum that reduces the risk of ignition while simultaneously promoting sufficient cooling of the cutting units. Because of the steeper angle of attack between the gas and liquid nozzles, the water jet is more strongly deflected from its original direction, thus ensuring more effective atomization. In doing so, it has been shown that a substantial enhancement of atomization occurs at angles larger than 45°, because in that case the normal component of one of the jets relative to the other jet is larger than the parallel direction component.

The spraying performance may be even further enhanced in that the liquid jet meets with the gas jet very close to the outlet of the latter, since there the air speed is the highest and particularly high shearing forces will enter into effect. In a preferred manner, the device according to the invention is, therefore, further developed such that the crossing point of the axes of the nozzles of a nozzle pair is located at a distance of less than 100 mm, preferably less than 50 mm, particularly preferred about 8 mm, from the nozzle outlet opening of the gas nozzle.

The fact that, according to the invention, the axes of the nozzles of a nozzle pair enclose an angle of between 45 and 135° naturally entails the risk of the liquid jet piercing the gas jet. In order to prevent this, it is advantageously provided that the outlet angles of the liquid nozzles amount to between 5° and 10°, whereby the liquid nozzles may be designed as circular section jet nozzles whose outlet openings preferably have diameters of about 1 mm. With such a configuration, the punctual impingement of the liquid jet on the gas jet will be prevented and a particularly uniform propagation of the liquid jet will be promoted, so that a fine mist having a uniform droplet distribution and droplet size distribution will be obtained.

In the region of the gas nozzle, optimization will be ensured in that the diameters of the outlet openings of the gas nozzles are at last 3 mm and, preferably, about 5 mm, wherein it may further be envisaged to configure the gas nozzle with a whirl chamber arranged upstream of said outlet opening to generate turbulent flows. Such a whirl chamber arranged upstream of the outlet opening allows turbulences to form in a manner that the gas jet will leave the nozzle as a turbulent flow, or with a twist. The efficacy of spraying will, thus, be further enhanced and the droplet diameter of the mist will be further reduced.

The individual parameters of the forming mist can be influenced by adjusting the gas supply pressure or liquid supply pressure, respectively, particularly favorable properties having been observed at adjusted gas pressures of 0.6 to 1.5 bar. In an advantageous manner, the configuration is therefore further developed such that the gas nozzles are designed for a gas supply pressure of 0.6 to 1.5 bar and the liquid nozzles are designed for a liquid supply pressure of 4 to 5 bar.

By the device according to the invention an extremely fine mist is formed in the region of the cutting tools, which mist also ensures the cooling of the tools in addition to reducing the risk of ignition. To this end, the nozzles are arranged on that side of the cutter head, on which the chisels enter the rock. Due to the Cuanda effect, the air-water mixture is effectively conducted through the cutting region so as to ensure such cooling effect within the contact zone and, to a major extent, even beyond engagement. In order to selectively apply such cooling effect on the chisels, the configuration advantageously is further developed in a manner that the axes of the gas nozzles are arranged to be directed onto the cutting tools and, in particular, tips of the chisels. The mist is thereby formed with a flow that is directed to the tips of the chisels so as to ensure the selective action on the cutter unit parts subjected to special loads, and provide sufficient cooling despite a reduced amount of liquid.

In order to produce a mist uniformly distributed over the entire length of the cutter head or cutter drum, a plurality of nozzle pairs are preferably arranged on a nozzle assembly connected with the cutter arm and extending parallel with the axis of rotation of the cutter head or cutter drum. In order to ensure sufficient mist density, the distance of neighboring nozzle pairs is advantageously less than 150 mm. In such a case, adequate nozzling of the cutting units will be ensured even if individual ones of the nozzles distributedly arranged over the length of the cutter head break down, since neighboring nozzle pairs enter into effect in the region of the broken-down nozzles on account of the suitable fanning out of the liquid-gas mixture.

In order to provide an easy adjustability of the nozzling parameters and, in particular, the angles between the axes of the liquid nozzles and the axes of the gas nozzles, and adapt the same to the respective operating conditions, the configuration is advantageously further developed in a manner that the nozzles are pivotally mounted in the nozzle assembly.

The nozzling device according to the invention renders feasible the obtainment of a substantially enhanced atomization of the liquid by observing optimum spraying conditions so as to reach a reduced risk of ignition, and an excellent extinguishing effect, even with small amounts of liquid. In addition, the visibility to the cutting unit will not be excessively obscured by the arrangement of the nozzle axes according to the invention. Since the nozzling system according to the invention also affords efficient dust abatement and chisel cooling, the nozzling system according to the invention may also be employed with socalled dry cutter heads, i.e., cutter heads that are not directly subjected to chisel nozzling.

In the following, the invention will be explained in more detail by way of an exemplary embodiment schematically illustrated in the drawing. Therein, FIG. 1 is a side view of an advance working machine including a nozzling device fixed to the cutter drive;

Figure 1:
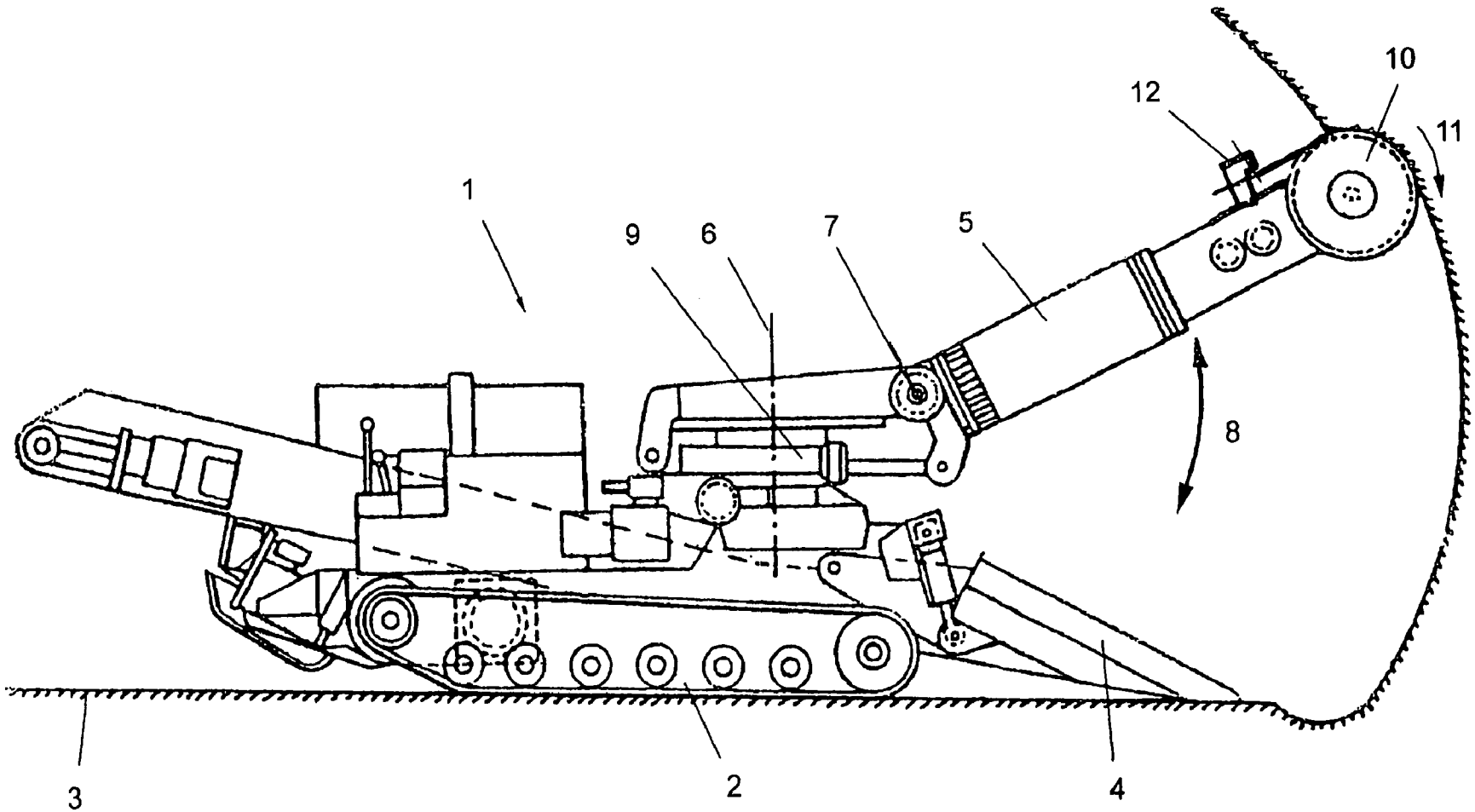

FIG. 1 depicts a cutting machine 1 which is displaceable by a crawler mechanism 2 on a floor 3. The cutting machine 1 comprises a charging device schematically indicated by 4 and a cutter arm 5 which is pivotable in the horizontal direction about a substantially vertical axis 6 and articulately connected so as to be pivotable in the vertical direction about a substantially horizontal axis 7 in the sense of double arrow 8. The pivot drive in the vertical direction is schematically indicated by a hydraulic cylinder piston unit 9. A haulage device is indicated on the rear end of the machine.

The cutter arm 5 carries cutter heads 10, which are rotationally driven in the sense of arrow 11. In the region of the cutter gear, a nozzle block 12 is fixed to the cutter arm 5, whose front view is depicted in FIG. 2.

Figure 2:
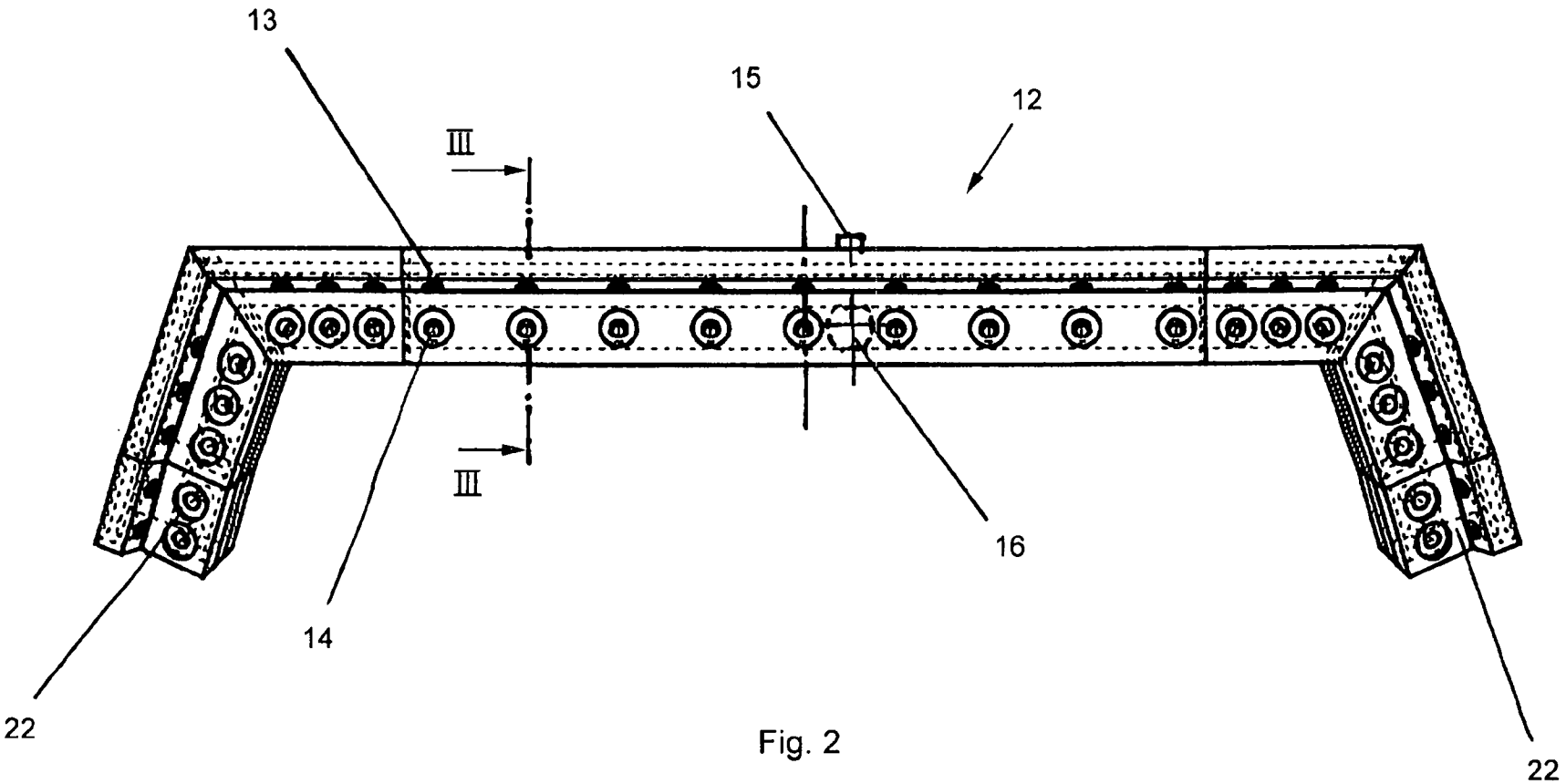
FIG. 2 is a front view of the nozzle block.

From FIG. 2 it is apparent that a plurality of nozzle pairs are arranged on the nozzle block 12, each nozzle pair being comprised of a liquid, particularly water, nozzle 13 and a gas, particularly air, nozzle 14. The common water connection is denoted by 15 and the common air connection is denoted by 16. The nozzle block extends over the width of the cutter head and, by the two lateral nozzle block projections 22, even over the left-hand and right-hand roof-section portions of the cutter head. In order to enhance the cooking effect, an additional nozzle block may be arranged on the lower side of the ranging arm such that the chisels will be aftercooled upon retraction from the cutting region.

Figure 3:
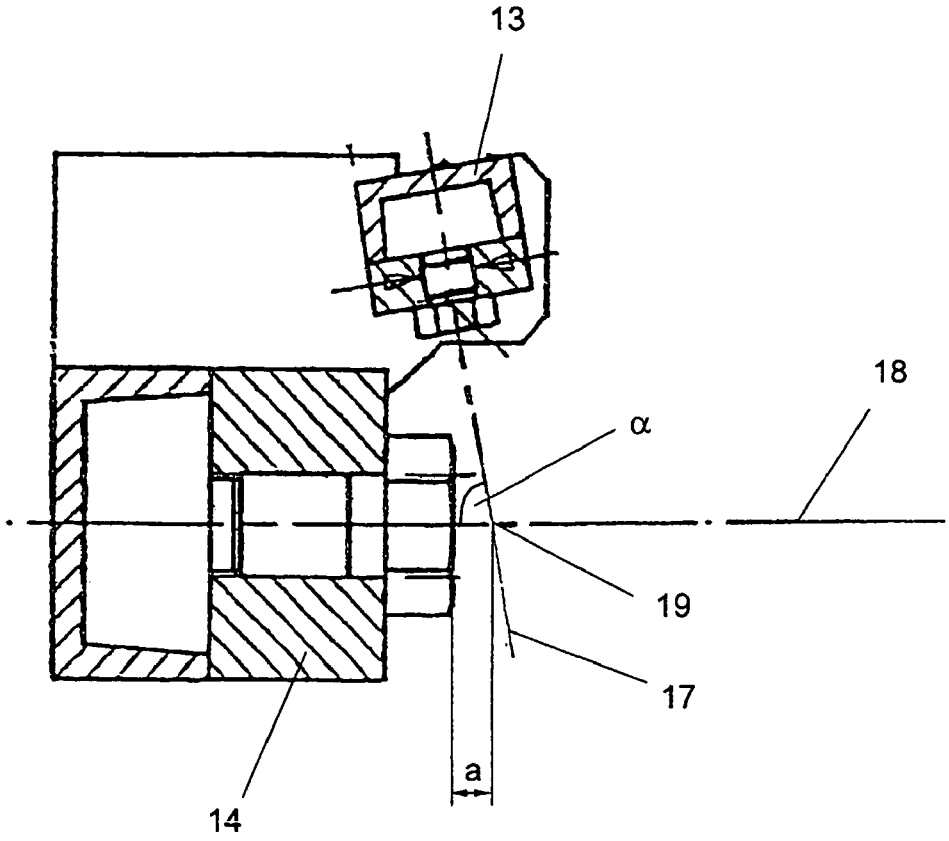
FIG. 3 is a section along line III—III of FIG. 2.

From the sectional view according to FIG. 3, the orientation of the nozzles 13 and 14 of a nozzle pair is apparent. The axes of the nozzles are denoted by 17 and 18, respectively, and, according to the invention, enclose an angle $\alpha$ of between 45 and 135°, the drawing depicting a particularly preferred angle of 80°. Furthermore, the nozzles are arranged in a manner that the point of impingement 19 is located at a distance a from the outlet opening of the air nozzle, which distance is preferably less than 100 mm. In the arrangement depicted in FIG. 3, the distance a in a particularly preferred manner is 8 mm.

Figure 4:
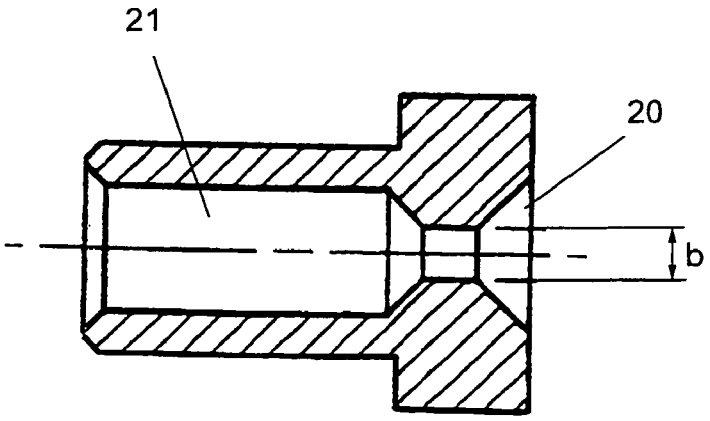
FIG. 4 is a section through an air nozzle.

FIG. 4 is an enlarged illustration of the outlet-side portion of the air nozzle 14 with a whirl chamber 21 being arranged upstream of the outlet opening 20 to cause the generation of turbulent flows. The inner diameter b of the air nozzle in a particularly preferred manner is about 5 mm.

The invention claimed is:

1. A device for producing a gas-liquid mixture in the vicinity of cutting tools arranged on at least one cutter head (10) or cutter drum rotationally mounted on a cutter arm (5) of a cutting machine (1), comprising at least one nozzle pair comprised of a nozzle (14) for ejecting a gas jet and a nozzle (13) for ejecting a liquid jet, axes (17, 18) of the nozzles (13, 14) of a nozzle pair being oriented in a manner that the jets impinge on each other at a distance from outlet openings of said nozzles (13, 14), wherein the axes (17, 18) of the nozzles (13, 14) of a nozzle pair form an angle with each other of between 45° and 135°, a crossing point of the axes (17, 18) of the nozzles (13, 14) of a nozzle pair is located at a distance of less than 100 mm from the outlet opening of the gas nozzle (14), and outlet angles of liquid nozzles (13) amount to between 5° and 10°.

2. The device according to claim 1, wherein liquid nozzles (13) are designed as circular section jet nozzles whose outlet openings have diameters of about 1 mm.

3. The device according to claim 1, wherein diameters of the outlet openings of the gas nozzles (14) are at least 3 mm.

4. The device according to claim 1, wherein the gas nozzles (14) are configured to comprise a whirl chamber arranged upstream of said outlet opening to generate turbulent flows.

5. The device according to claim 1, wherein the gas nozzles (14) are designed for a gas supply pressure of 0.6 to 1.5 bar and the liquid nozzles (13) are designed for a liquid supply pressure of 4 to 5 bar.

6. The device according to claim 1, wherein the axes (18) of the gas nozzles (14) are arranged to be directed onto the cutting tools.

7. The device according to claim 1, wherein a plurality of nozzle pairs are arranged on a nozzle assembly (12) connected with the cutter arm (5) and extending parallel with an axis of rotation (8) of the cutter head (10).

8. The device according to ciaim 1, wherein distance between neighboring nozzle pairs is less than 150 mm.

9. The device according to claim 7, wherein the nozzles (13, 14) are pivotally mounted in the nozzle assembly (12).

10. The device according to claim 1, wherein the cutting tools are chisels.

11. The device according to claim 1, wherein the axes (17, 18) of the nozzles (13, 14) of a nozzle pair form an angle with each other of between 75° and 85°.

12. The device according to claim 1 wherein a crossing point of the axes (17, 18) of the nozzles (13, 14) of a nozzle pair is located at a distance of less than 50 mm from the outlet opening of the gas nozzle (14).

13. The device according to claim 1, wherein a crossing point of the axes (17, 18) of the nozzles (13, 14) of a nozzle pair is located at a distance of about 8 mm from the outlet opening of the gas nozzle (14).

14. The device according to claim 1, wherein diameters of the outlet openings of the gas nozzles (14) are about 5 mm.

15. The device according to claim 10, wherein the axes (18) of the gas nozzles (14) are arranged to be directed onto tips of the chisels.

* * * * *